United States Patent [19]

Jordan

[11] Patent Number: 4,944,063

[45] Date of Patent: Jul. 31, 1990

[54] GOLF CLUB WASHER

[76] Inventor: Johnny Jordan, 1004 S. Eric, Monahans, Tex. 79756

[21] Appl. No.: 306,918

[22] Filed: May 1, 1989

[51] Int. Cl.[5] ..... A63B 57/00

[52] U.S. Cl. ..... 15/104.92; 15/21 R; 15/21 A; 15/160

[58] Field of Search ..... 15/104.92, 160, 21 A, 15/21 R, 38, 39, 104.5

[56] References Cited

U.S. PATENT DOCUMENTS 4,069,536 1/1978 Hartz ..... 15/104.92
4,380,839 4/1983 Caradonna ..... 15/104.92
4,734,952 4/1988 Parchment et al. ..... 15/104.92
4,821,358 4/1989 Wyckoff ..... 15/104.92

*Primary Examiner*—Edward L. Roberts

[57] ABSTRACT

Apparatus that can be attached to a golf cart or the like for washing the face of a golf club. The iron club is placed within an opening formed in the top of the golf club washer. With one hand holding the club steady, the other hand holds the upper part of a brush handle which protrudes out of the top of the golf club washer. The brush is moved with an up-and-down motion causing the brush to clean the face of the iron club. After several up-and-down motions, the cleaned club is removed from the golf club washer.

4 Claims, 2 Drawing Sheets

FIG. 4
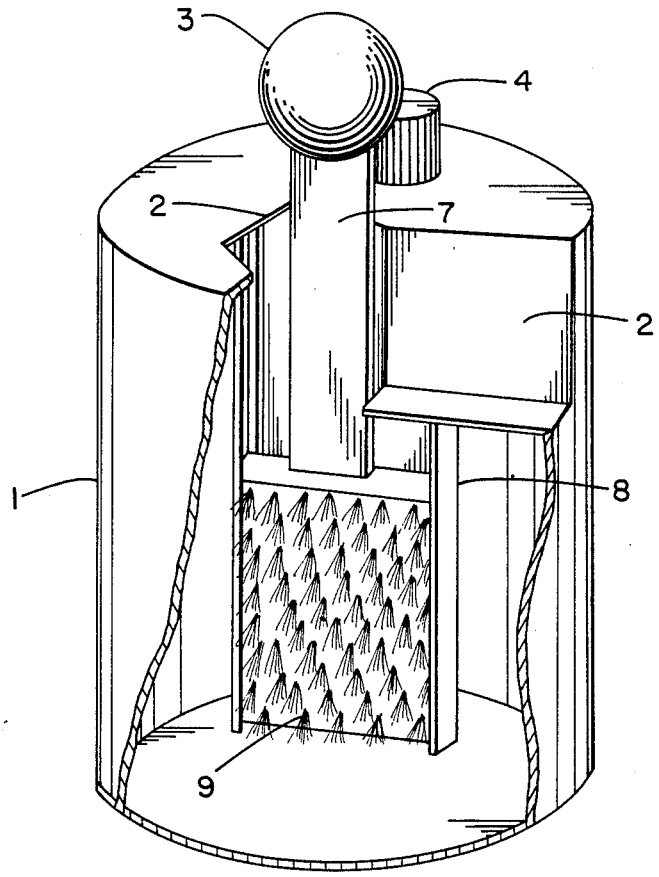
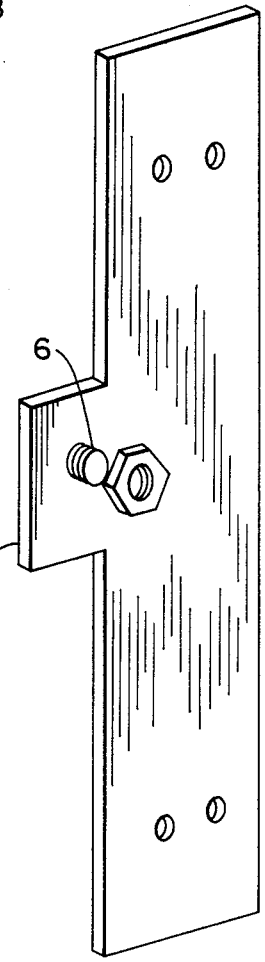
FIG. 5A
FIG. 5B
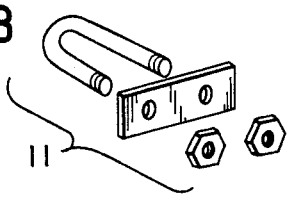

GOLF CLUB WASHER

TECHNICAL FIELD

This invention is an iron golf club washing device. During the course of playing golf, by the nature of the sport, golf clubs become soiled with grass and dirt. The golf club washer removes this grass and dirt. The golf club washer is used primarily by golf cart users but can also be attached to permanent stands at tee boxes.

BACKGROUND ART

Several golf club washers have been made. Four examples are represented by U.S. Pat. Nos. 4,069,536; 4,380,839; 4,734,952; and 4,821,358. All of these examples contain two (2) brushes and the golf club is moved up and down between the brushes. The most expensive part of a golf club washer is the brush. In this golf club washer there is only one brush which is adequate because the back of the iron golf club is seldom dirty. In addition, the brush will eventually wear out and have to be replaced. The one-brush golf club washer will be less expensive to maintain.

SUMMARY OF THE INVENTION

Golf clubs are manufactured with grooves in the hitting face of the club. When the club strikes a golf ball, the grooves provide more control of the direction the ball travels and also causes the ball to have "backspin" which provides more accurate shots by the golfer. It is important mechanically for the golf club to be clean. In addition, psychologically and emotionally a clean golf club is important to the golfer. A clean club gives the golfer more confidence in making a good shot. A majority of the golfers today clean their clubs during play by carrying a wet, dripping towel. This process is a messy, inconvenient way to clean clubs and during cold weather can cause cold hands and fingers which is not comfortable for the golfer. The golf club washer is more efficient and convenient method of washing clubs. This invention is a cylindrical shaped, sturdy plastic container that holds a solution of soap and water. The top of the container has an opening into which is placed the head of the iron golf club with the shaft of the club horizontal to the ground and resting in a slot that leads to the opening. A brush is enclosed inside the container with the handle protruding out the top of the container. The brush travels up and down in a chute that is positioned so the brush comes in contact with the face of the iron golf club. The container holds a solution of soap and water and the brush is immersed in the solution. As the brush travels upward from the bottom of the container it carries some of the solution in its bristles and makes contact with the face of the iron golf club. The abrasive action of the brush and the solution cleans the face of the iron golf club.

The golf club washer will be used primarily by owners of golf carts. A majority of golf carts come equipped with a top for the purpose of providing protection from the sun and rain. The support poles for the tops are positioned at different angles according to the manufacturer. Attached to the golf club cleaner is a brace that is connected to the cleaner by one bolt which allows the container to be rotated so as to be in a vertical position regardless of which make of golf cart is used. The brace of the cleaner is attached to the golf cart top support poles by two "U" bolts. Before tightening the "U" bolt nuts, the container may be moved to the users most desired position.

BRIEF DESCRIPTION OF THE DRAWINGS

FIG. 4 is a partial sectional view of the embodiment of FIG. 1.

FIG. 5 is a perspective view of the brace and bolts used to attach the invention to a golf cart.

DESCRIPTION OF THE PREFERRED EMBODIMENT

Reference should be made to the drawings in which the same reference numbers are used with the different figures to designate the same components. The golf club washer of a preferred embodiment of the invention includes a cylindrical housing 1, FIGS. 1, 2, 3 and 4, made of sturdy plastic and enclosed on top and bottom. The top of the washer has an opening 2, FIGS. 1, 2 and 4. The head of an iron golf club is placed in the large part of the opening 2 with the shaft of the club resting in the small part of the opening 2. The top of the washer has a threaded extension and cap 4, FIGS. 1, 2 and 4, which protrudes upward out of the top for the purpose of filling the washer with a cleaning solution of water and soap. The bottom of the washer has a threaded extension and cap 5, FIGS. 1 and 3, which protrudes downward out of the bottom for the purpose of draining the cleaning solution from the washer.

Figure 1:
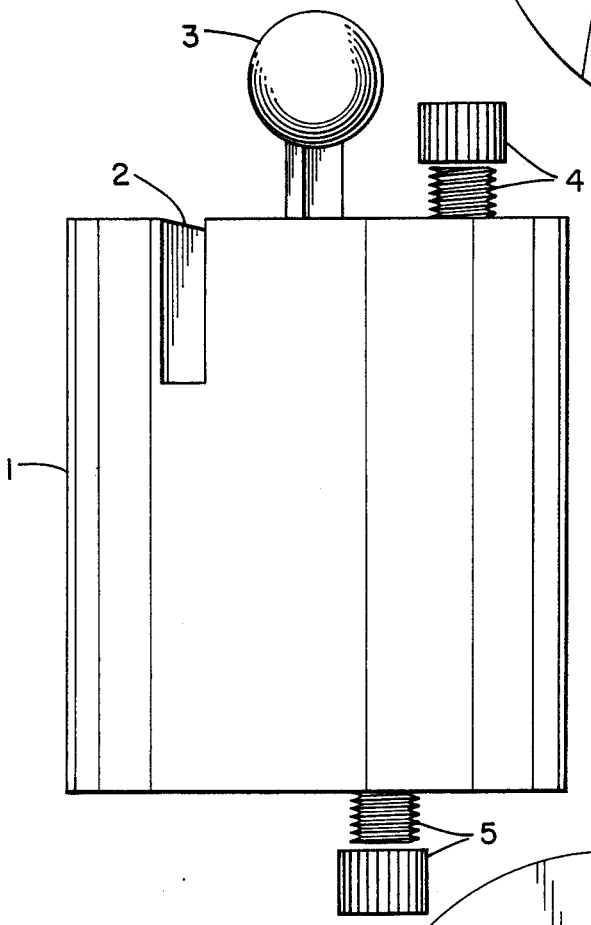
FIG. 1 is a front perspective view of an embodiment according to the invention.
Figure 2:
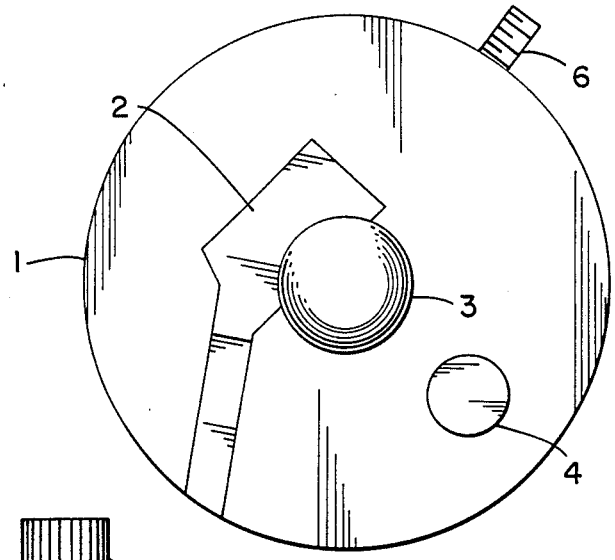
FIG. 2 is a top perspective view of the embodiment of FIG. 1.

A brush 9, FIG. 4, with handle 7, FIG. 4, and ball-shaped grip 3, FIGS. 1, 2 and 4, travels up and down a chute 8, FIG. 4. Part of the handle 7 and the ball-shaped grip 3 protrude out of the top of the washer. The ball-shaped grip 3 is held in one hand by the golfer and moved in an up and down motion which causes the brush 9 to come in contact with the face of the iron golf club which has been placed in the opening 2 in the top of the washer. The brush 9 carries the cleaning solution contained in the washer to the face of the iron golf club and the combination of bristles and cleaning solution cleans the iron golf club.

Figure 3:
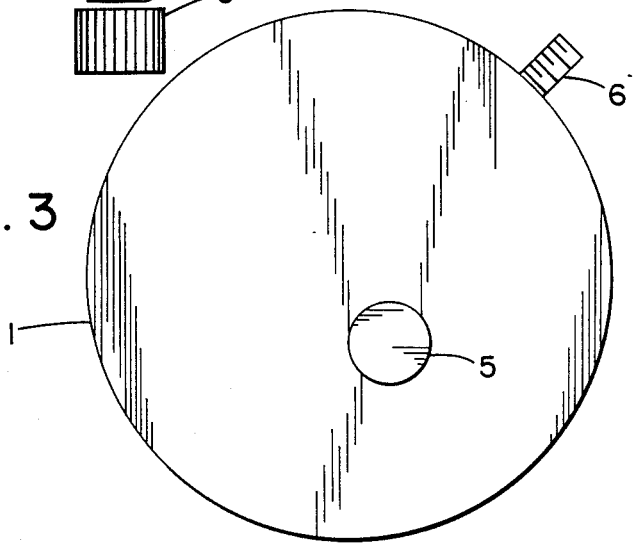
FIG. 3 is a bottom perspective view of the embodiment of FIG. 1.

The brace 10, FIG. 5, is attached to the golf club washer by the threaded nut and bolt 6 FIGS. 2, 3 and 5. The brace 10 with the golf club washer attached is then attached to a golf cart using two U-bolts and nuts 11, FIG. 5. The U-bolts 11 are attached to the vertical supporting legs of the golf cart top.

While there has been shown and described a preferred embodiment of the invention, it is understood that various changes, omissions and substitutions may be made by those skilled in the art.

I claim:

1. Apparatus for washing the face of a golf club comprising an upwardly opening container for holding a solution of water and soap;

a closure member for said container, a slot opening where an iron golf club is held in captured relationship respective to said container, a wash brush having a handle opposed to a brush, means reciprocatingly mounting said wash brush within the container with the brush contacting the face of the golf club and the brush handle extending from the top of the container;

whereby a golf club can be placed in said slot with the golf club face contacting the brush, the brush is reciprocated to wash the golf club face.

2. The apparatus of claim 1 wherein a vertical tunnel captures the brush for movement therein; said slot opening terminates at the tunnel and radially extends therefrom.

3. The apparatus of claim 2 wherein the brush face scrubs the club face as the brush is reciprocated within the tunnel.

4. The apparatus of claim 3 wherein the container includes means by which it is mounted on a golf cart.

* * * * *